United States Patent [19]

Koorneef

[11] 4,222,159

[45] Sep. 16, 1980

[54] METHOD OF MANUFACTURING A COLOR DISPLAY TUBE SHADOW MASK

[75] Inventor: Jacob Koorneef, Eindhoven, Netherlands

[73] Assignee: U.S. Philips Corporation, New York, N.Y.

[21] Appl. No.: 35,951

[22] Filed: May 4, 1979

Related U.S. Application Data

[63] Continuation of Ser. No. 893,939, Apr. 6, 1978, abandoned, which is a continuation of Ser. No. 759,112, Jan. 13, 1977, abandoned.

[30] Foreign Application Priority Data

Jan. 16, 1976 [NL] Netherlands ..... 7600418

[51] Int. Cl.[3] ..... H01J 9/14; H01J 9/02

[52] U.S. Cl. ..... 29/25.14; 29/25.16

[58] Field of Search ..... 29/25.13, 25.14, 25.15, 29/25.16

[56] References Cited

U.S. PATENT DOCUMENTS

| | | | |
|---|---|---|---|
| 3,586,900 | 6/1971 | Seki et al. | 313/85 X |
| 4,059,781 | 11/1977 | Alphen et al. | 313/403 |

*Primary Examiner*—Richard B. Lazarus

*Attorney, Agent, or Firm*—Simon L. Cohen

[57] ABSTRACT

A method of manufacturing a color display tube of the refocusing type in which supports of insulation material are secured against an apertured metal plate. The supports are provided with a conductor at least on the side remote from the plate, so that the plate constitutes a first set of lens electrodes and the conductors constitute a second set of lens electrodes. The two sets of lens electrodes form a quadrupole lens in each aperture in the metal plate when a voltage difference is applied between the first set and the second set. The defocusing direction of the quadrupole lens is parallel to the phosphor strips of the display screen.

11 Claims, 14 Drawing Figures

METHOD OF MANUFACTURING A COLOR DISPLAY TUBE SHADOW MASK

Figure 1:
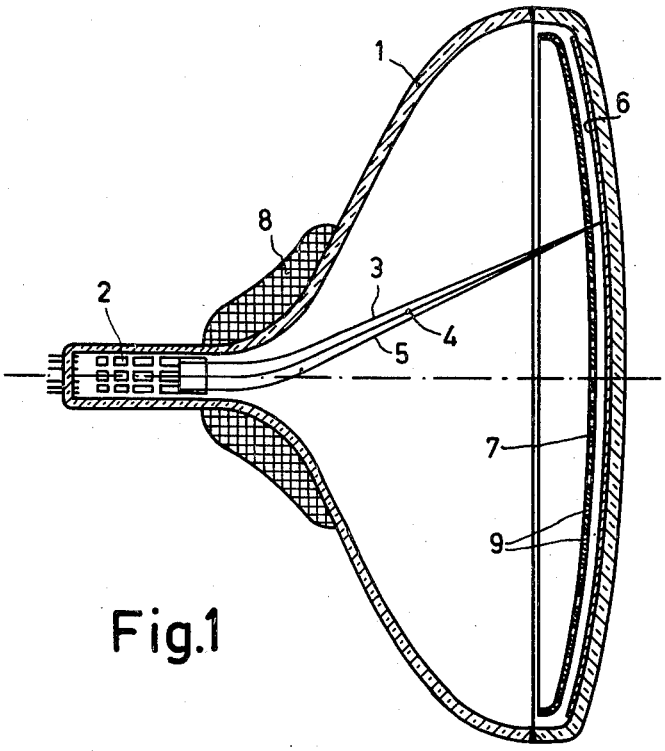

This is a continuation of Ser. No. 893,939 filed Apr. 6, 1978 which in turn is a continuation of Ser. No. 759,112 filed Jan. 13, 1977 both now abandoned.

The invention relates to a method of manufacturing a colour display tube comprising, in an evacuated envelope, means to generate a number of electron beams, a display screen having a large number of regions luminescing in different colours, and colour selection means having a large number of apertures which associate each electron beam with luminescent regions of one colour, and electrodes for forming an electron lens in each aperture.

The invention also relates to a colour display tube manufactured according to the method and to a device for carrying out the method.

Such a colour display tube of the post-deflection focusing type is disclosed in U.S. Pat. No. 3,398,309. The object of post-focusing is to increase the brightness of the displayed picture by increasing the transmission of the colour selection means. In tubes without post-focusing a very large part, for example 80 to 85% of the electrons in the beams is intercepted by the shadow mask. By using post-focusing, the apertures in the colour selection means can be enlarged, since the beams are focused as they pass through the apertures. As a result, the electron spots on the screen are considerably smaller than the apertures so that in spite of the increased aperture size there is sufficient landing tolerance.

The electron lens which is formed in the apertures of shadow mask of the known tubes is of the unipotential type so that a rather large voltage difference is required between the electrodes which form the lens.

Another post-focusing tube is described in U.S. Pat. No. 2,728,024. In this tube the electron beams pass successively through two grids each consisting of parallel conductors. The conductors associated with different grids are at right angles to each other. With such an arrangement, the electron beams are focused successively by two electron-optical cylinder lenses which are rotated 90° relative to each other. By the action of both lenses together, the electron beams are focused in one direction and defocused in a direction at right angles thereto.

A drawback of this known tube is that it also requires a rather large voltage difference for focusing. In addition, the two grids do not form a mechanical unit so that vibration of the grid wires presents great problems. Furthermore, this lens arrangement requires a flat display screen.

It is an object of the invention to provide a method of manufacturing colour display tubes of the kind mentioned in the preamble which is inexpensive, can be carried out on a large scale and is easy to mechanize.

Another object of the invention is to provide a method of manufacturing a colour display tube of the kind mentioned in the preamble which does not require a large voltage difference for focusing the beam.

Still another object of the invention is to provide a device for carrying out this method.

In the method of the invention, the colour selection means or shadow mask is manufactured by securing supports of insulating material to an apertured metal plate. The supports are provided with elongate conductors at least on the side thereof from the plate. The plate constitutes a first set of lens electrodes and the metal conductors constitute a second set of lens electrodes.

The great advantage of the method according to the invention is that it results in very little loss of material. In addition, the method is very suitable for mass production.

The metal plate determines the geometric shape of the colour selections means. A system of elongate electric conductors is provided thereon which are separated from the plate by the insulating supports. The supports may be in the form of strips and be provided between the whole elongate conductor and the metal plate, or support the conductor in a number of places in that a number of areas projecting in the direction of the metal plate are provided on the conductor and form the supports. In this manner, a quadrupole lens is formed in each aperture of the colour selection means upon application of a voltage difference between the conductors and the plate. Since the electric field is normal, or substantially normal to the electron path, quadrupole lenses, are much stronger than cylinder lenses, so that much lower voltages will suffice. The fact that quadrupole lens focuses in one direction and defocuses in a direction of right angles thereto does not adversely affect the operation of the tube when all quadrupoles have the same orientation and, in addition, the luminescent regions of the display screen, preferably, have the shape of substantially parallel strips whose longitudinal direction is substantially parallel to the defocusing direction of the quadrupole lenses.

It is possible to secure the supports with the conductors to the metal plate or to stretch them against the metal plate by means of at least one resilient element at the ends. When the supports are secured to a connection strip with their ends, one resilient element is enough. It is also possible to secure each support by means of a resilient element secured to its end, so that the support is stretched against the metal plate.

The metal plate may be provided with long apertures so that a frame of lines is formed and the supports are provided substantially at right angles to the frame of lines. It is necessary for the supports to be also provided, on the side-facing the plate, with conductors in order to prevent charging by the electron beam. As a matter of fact, without the latter conductors, the electron beam would "see" insulating material.

It is also possible for the plate to be provided with a large number of apertures arranged in parallel rows and columns and for the supports with conductors to be provided between the rows of apertures.

The supports may consist of glass and be provided against the plate in the soft condition. Glass supports adhere to the metal plate. However, they are also sufficiently flexible to be provided in a frame together with the elongate conductors and to be stretched against the plate by at least one resilient element, as has been described above.

Supports of a synthetic material, preferably polyimide (for example, the polyimide of 4–4′ diaminodiphenyl ether and 1-2-4-5 benzenetetracarbonic acid anhydride, known as Kapton) have proved to be particularly suitable. Elongate metal conductors in the form of a metal wire or metal film, preferably consisting of aluminum, are provided on these supports at least on the side remote from the metal plate. However, it is also possible to use gold and other suitable metals.

Another suitable embodiment of the invention is that in which the supports provided with conductors are obtained by anodizing aluminum on one side. This may be done by anodizing aluminum strips on one side (the side afterwards facing the plate) or by dividing an aluminum plate anodized on one side into strips (for example, cutting it with an electron beam or a laser beam).

The elongate conductors preferably have the form of a metal film having a thickness which is smaller than 2 μm. Metal chips which may be formed during the manufacture of the strips will then be so thin that they will be evaporated by the passage of relatively low current when the chip short circuits the two sets of lens electrodes. In this manner, any short-circuit between the two sets of lens electrodes is automatically removed.

A suitable device for carrying out the method comprises a reel for storing a roll of insulation material covered at least on one side with a conductor, a reel for storing a roll of plate material provided with apertures, a cutting device for forming the supports by cutting the web of insulation material into strips, a roller-like pressure member for pressing the supports and the plate material together in the desired places, and a heating device for heating the supports and the plate material. The heating device may include, for example, one or more heating lamps or elements. Heating may also be carried out by means of a high-frequency electromagnetic field. The pressure member for pressing together the supports and the plate material preferably includes a roller with grooves which guides the supports so that they are pressed against the plate material in the correct positions. By combination of the heating device and the pressure member, and with a suitable choice of the material for the roller-like pressure member, the distance between two supports comprising a metal film can be varied and adapted to, for example, small variations in the pitch of the apertures in the plate material by a variation in the temperature difference between the pressure member and the plate material as a result of which the pressure member expands or shrinks. It has been found that a roller-like pressure member of aluminum which is provided with a heating device gives very good results in the case of steel plate material.

The invention is particularly suitable for mass production of the colour-selection mask described above.

Figure 2:
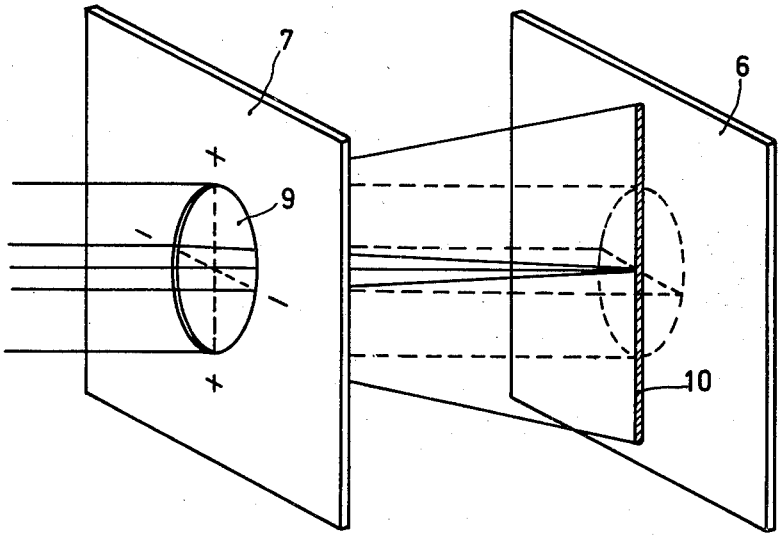
Figure 3:
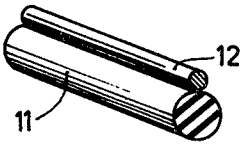
Figure 4:
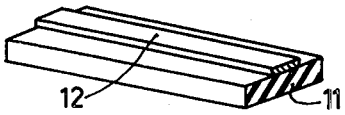
Figure 5A:
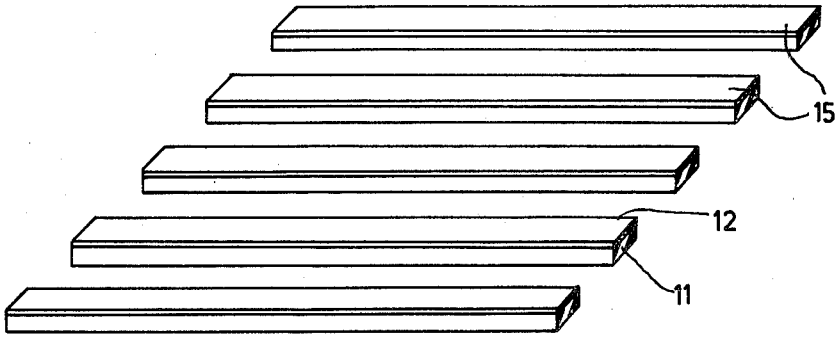
Figure 6:
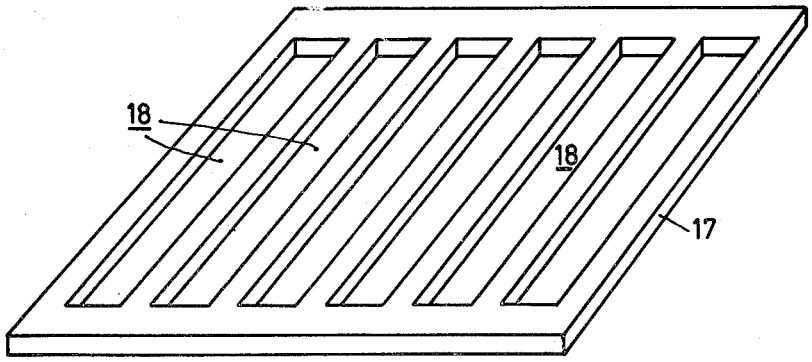
Figure 7A:
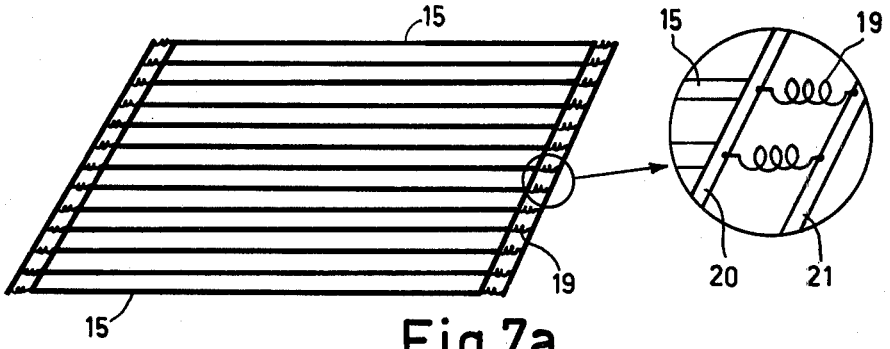
Figure 7B:
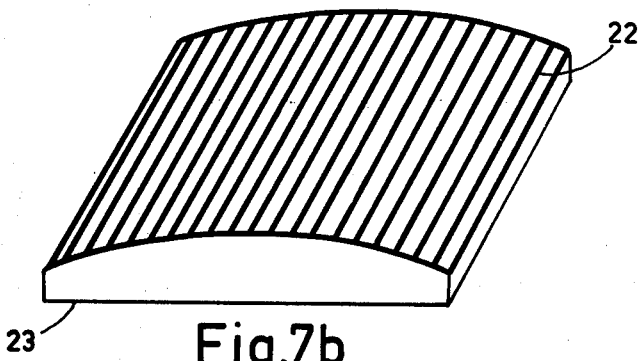
Figure 7C:
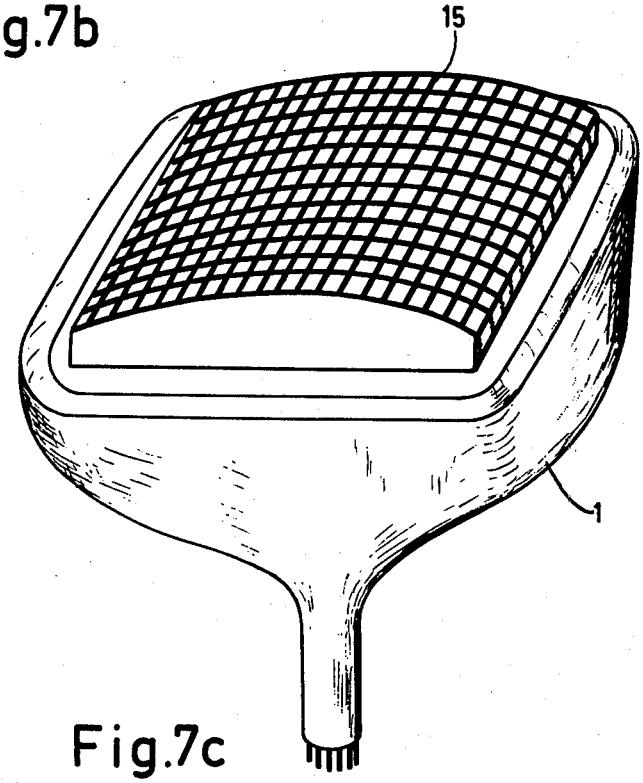
Figures 8, 9:
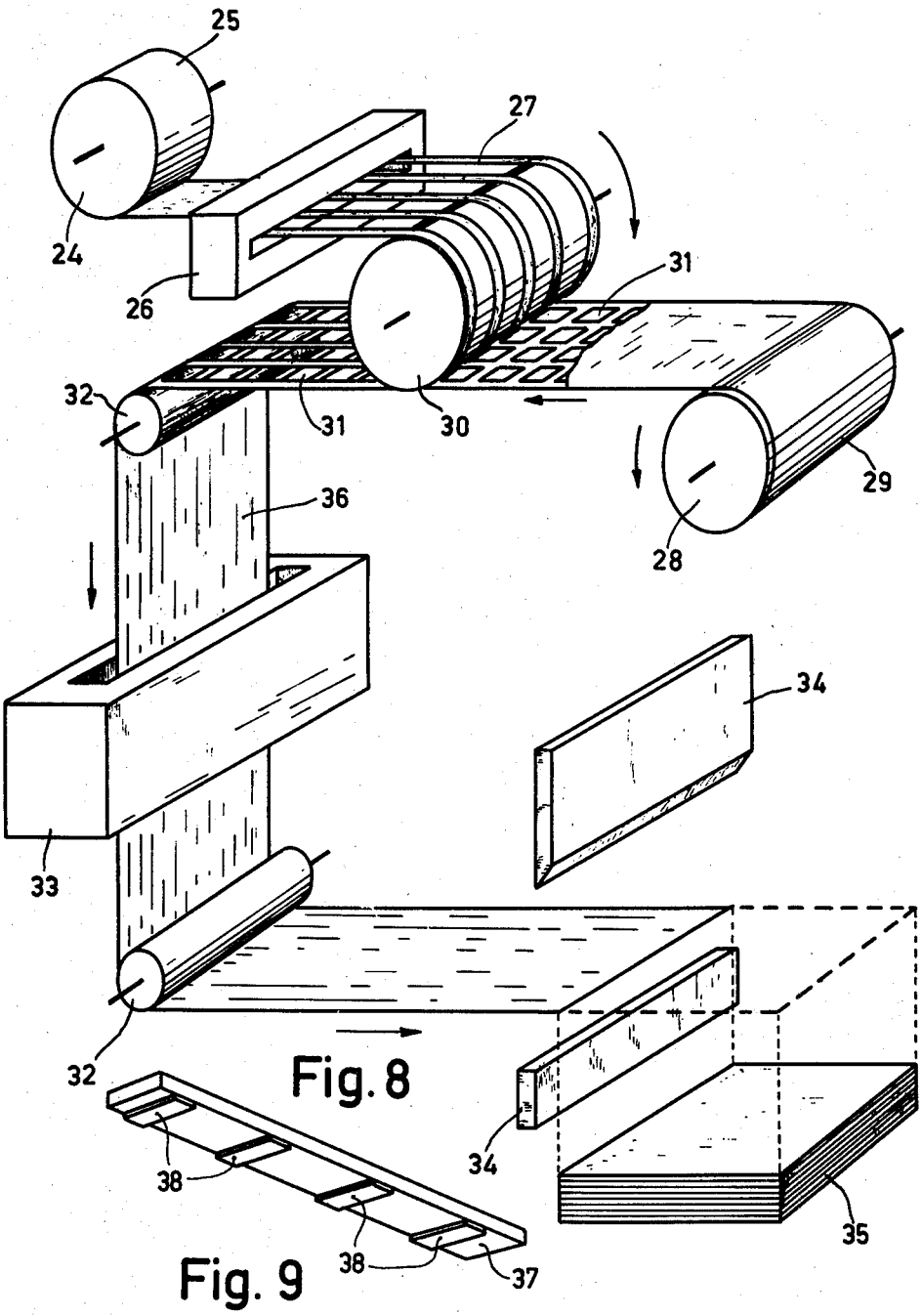

Embodiments of the invention will now be described by way of example with reference to the diagramatic drawings, in which:

FIG. 1 shows a cathode ray tube manufactured by means of the method according to the invention, FIG. 2 illustrates diagrammatically the operation of a quadrupole lens, FIGS. 3 and 4 show two embodiments of elongate supports with conductors, FIGS. 5*a*, *b*, *c* and *d*, and FIG. 6 further illustrate a method embodying to the invention, FIGS. 7*a*, 7*b* and 7*c* shows the connection of the supports by means of a resilient element, and FIG. 8 shows a device for carrying out a method embodying to the invention, FIG. 9 shows another embodiment of FIGS. 3 and 4.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue whose longitudinal direction is at right angles to the plane of the drawing of FIG. 1. During normal operation of the tube, the phosphor strips are vertical and FIG. 1, hence, is a section view at right angles to the phosphor strips. The colour selection means 7 has a large number of apertures 9 which are shown diagrammatically in FIG. 1. The three electron beams 3, 4 and 5 pass through the apertures 9 at a small angle with each other and therefore each impinges only upon phosphor strips of one colour. The apertures 9 in the colour selection means 7 are thus very accurately positioned relative to the phosphor strips of the display screen 6.

In most shadow mask tubes generally used at the present time, the electron beams 3, 4 and 5 are not focused upon passing through the apertures 9. In U.S. Pat. No. 3,398,309, mentioned above, unipotential lenses for focusing the electron beams are formed in the apertures 9. It has also been suggested to postfocus the beams by means of a potential difference between the colour selection means 7 and the display screen 6. In such an arrangement, however, secondary electrons have a very annoying effect.

In colour display tubes manufactured by means of the method of the invention, a quadrupole lens is formed in each aperture 9 of the colour selection means 7. FIG. 2 illustrates a part of the colour selection means 7 and one of the apertures 9. As shown in FIG. 2, the potential variation along the edge of the aperture 9 is alternately +, −, +, − so that a quadrupole field is formed in the aperture. The electron beam passing through the aperture 9 is focused in the vertical plane so that an electron spot 10 is formed when the display screen is exactly at the horizontal focus. It is, however, preferable not to focus the beam exactly on the display screen 6 so that a slightly wider electron spot is obtained, However, the spot should be sufficiently narrow to prevent landing errors.

The fact that the electron beam passes through the aperture 9 at a small angle has only a minor effect on the focusing so that the colour selection of the three electron beams 3, 4 and 5 is effected in a manner quite analogous to that in known shadow mask tubes. As a result of the strong focusing, however, the aperture 9 may be made much larger than in known shadow mask tubes, so that a far higher percentage of electrons impinges upon the display screen 6 and a brighter picture is obtained. The defocusing in the vertical direction need not be objectionable when phosphor strips are used which are parallel to the longitudinal direction of the spot 10.

According to the invention, the colour selection means 7 is made by securing supports of insulation material to an apertured metal plate. The supports are provided with elongate conductors at least on the side remote from the plate. The apertured plate forms a first set of lens electrodes and the conductors on the supports constitute a second set of lens electrodes. FIGS. 3, 4 and 9 show three possible shapes for the supports. FIG. 3 shows, a glass support 11 with an aluminum conductor 12 in the form of a wire. During manufacture, the support 11, while in soft condition, is secured to an apertured metal plate, the conductor being more or less embedded in the glass. FIG. 4 shows another embodiment. The support 11 in this case consists of a strip of insulating material, for example polyimide, with a metal film, for example aluminum or gold, which forms a conductor 12. The metal film may, if desired have the same width as the support, in which case, the supports may be cut from a foil which is provided with a metal film.

FIG. 9 shows an embodiment in which, in contrast to the structures shown in FIGS. 3 and 4, the support does not support the entire conductor, but rather, supports it in a restricted number of places. For this purpose, the conductor is provided with supports 38 of insulating material. Stresses due to expansion upon heating of the conductor are better compensated for by this support.

Figure 5B:
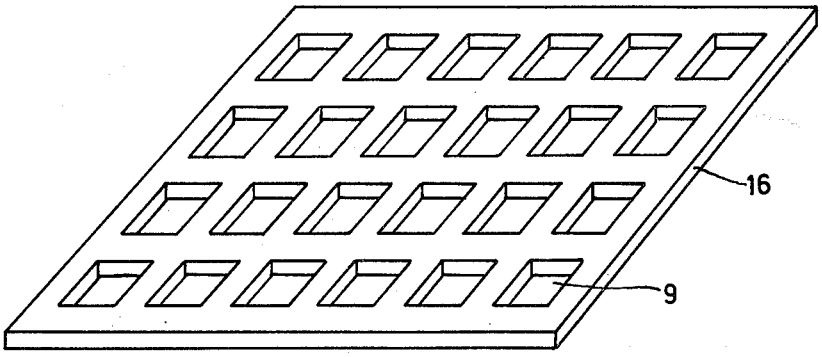
Figure 5C:
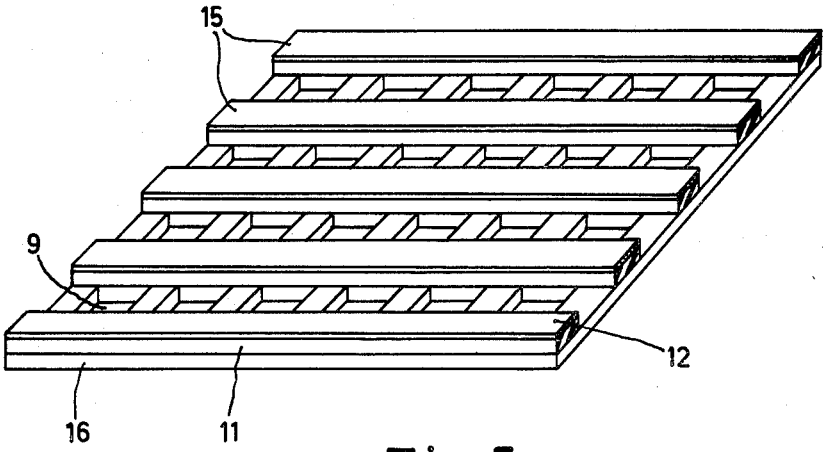
Figure 5D:
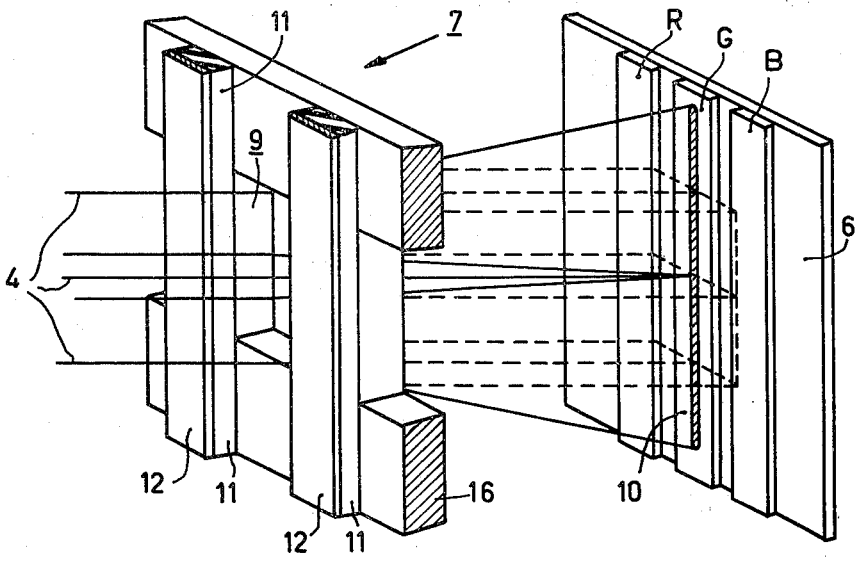

FIG. 5*a* diagrammatically shows portions of a number of substantially parallel electrodes 15 each having a support 11 carrying a conductor 12 in the form of a metal film. The electrodes 15, which in the finished device are connected together, at, for example, their ends by strips, are secured between the apertures 9 of a metal plate 16 of FIG. 5*b*. In this manner a system of lens electrodes is obtained such as that shown in FIG. 5*c*. By applying a potential difference between the metal plate 16 and the conductors 12, a quadrupole field is formed in each aperture 9. FIG. 5*d* shows the operation of such a quadrupole lens. The colour selection means 7 consists of a set of parallel supports 11, each provided with a metal conductor 12 and secured to a metal plate 16. The metal conductors 12 and the portions of the metal plate 16 around aperture 9 constitute the poles of the quadrupole lens. The display screen 6 is provided with three phosphor strips associated with the aperture 9, which are denoted by R (red), G (green) and B (blue). The FIG. shows only a few rays of the central electron beam 4 which form the electron spot 10 on the phosphor strip G. The interconnected conductors 12 are at a lower potential than the potential of the metal plate 16 so that the quadrupole lens shown diagrammatically in FIG. 2 is formed in each aperture 9.

Advantageously, the metal plate 16 has a thickness between 100 and 200 μm. The thickness of the supports 11 is preferably between 20 and 150 μm and depends, inter alia, on the kind of insulation material used. As stated above, the metal film preferably has a thickness smaller than 2 μm. The distance between the centres of two adjacent apertures in a row is approximately 700 to 800 μm. The portions of the plate 16 between the apertures have a width of approximately 200 μm. The width of the supports is preferably smaller than 180 μm. The plate usually consists of a ferromagnetic material.

FIG. 6 shows a metal plate 17 having apertures 18. However, these apertures 18 are very long so that the plate 17 has a low rigidity and has to be secured in the wall of the tube envelope or in a frame such as frame 23 shown in FIG. 7*b*. The supports 11 shown in FIG. 5*a* are secured to such a plate in a manner such that their direction is substantially at right angles to the longitudinal direction of the apertures 18 in plate 17. In addition, the supports 11 on the side facing the plate should be provided with a conductor to prevent charging by the electron beams.

In the embodiments shown in FIG. 5 and FIG. 6, the supports 11 may be glued to the plates 16 and 17, respectively. It has been found that several methods can give good result, dependent upon the material used. When the material of the supports is, for example, the polyimide of 4–4′ diaminodiphenyl ether and 1-2-4-5 benzenetetracarbonic acid dianhydride, then the polyamide of the same materials in a solvent is very suitable to glue the polyimide supports to the plate material. Upon heating, the polyamide is converted into the polyimide and adheres to the plate 16.

It is also possible to secure the supports 11 to the metal plate 17 by stretching them against it by means of at least one resilient element 19, as shown diagrammatically in FIGS. 7*a, b* and *c*. The ends of the electrodes 15 are connected to strips 20. The strips 20 are in turn connected to strips 21 by means of a number of resilient elements 19, for example springs or pieces of elastic material. FIG. 7*b* shows a metal plate 22 of a shape such as that shown in FIG. 6 which is bent on a 23 which also serves for reinforcement. By also securing the strips 21 to the frame 23, the system of parallel electrodes 15 is stretched across the metal plate 22 as is shown in FIG. 7*c*. The frame 23 is suspended in the envelope in the usual manner. This method of securing proves to be possible even with a large number of glass supports 11 such as those illustratated in FIG. 3.

FIG. 8 diagrammatically shows an example of a device for carrying out a method embodying the invention. The device comprises a reel 24 carrying a roll 25 of polyimide foil which is covered with a metal film, a cutting device 26 to form the electrodes 27 and a reel 28 carrying a roll of plate material 29 of the configuration illustrated in FIG. 5*b*. The 100 μm thick polyimide foil is provided on one side with an aluminum foil 1 μm thick and is cut into strips which form the electrodes 27. A pressure roller 30 presses the strips between the apertures 31 of the metal plate 29 which is covered with a polyamide solution. It is alternatively possible to provide the polyamide solution on the strips 27. In this manner the strip 36 of lens electrodes is obtained of the configuration illustrated in FIG. 5*c*. The strip 36 is guided with the aid of guide rolls 32, through a high-frequency furnace, 33, in which the polyamide is converted into polyimide. After leaving the furnace a knife 34 cuts the strip 36 into plates 35. The plates, possibly after a drawing process in which they are drawn in a curved shape, constitute the colour selection means 7. It is also possible to first cut the electrode assembly 36 into plates 35 and then treat them in a furnace. The parallel electrodes 27 in each plate 35 are connected together electrically by a connection strip (not shown). The connection of the supports between the apertures 31 in the plate material 29 is carried out by positioning the supports prior to securing by means of pin-shaped or slot-shaped guides. However, it is alternatively possible to provide the pressure roller 30 with a number of grooves which is equal to the number of supports, the depth of the grooves being slightly smaller than the thickness of the supports. By the combination of such a pressure roller with a heating device, for example a heating coil in the roller, the distance between two grooves and hence between two supports can be varied and be adapted, for example, to small variations in the pitch of the apertures in the plate material 29, with a suitable choice of the material of the roller by a variation in the temperature difference between the roller and the plate as a result of which the roller expands or shrinks. An aluminium pressure roller has been found to give very good results with steel plates.

It is alternatively possible to cover the supports 11 on the side facing the plate with a metal which produces a diffusion connection between the electrodes 27 and the plate material 29 by the pressure of the pressure roller 30 and/or the thermal treatment in the furnace 33.

A display screen for a tube embodying the invention can be manufactured with a known exposure method, in which the colour selection means are reproduced on a photosensitive layer on a window portion of the tube.

Small variations in the distance between the supports may cause errors in width of the phosphor strips (R, G and B, FIG. 5*d*). By using a device illustrated in FIG. 8, such variations and hence errors can be minimized since the distance between the supports can be set quite accurately.

Because of the improved transmissivity attainable by the colour selection means, the exposure method used should be suitable to reproduce the apertures 9 in a strongly narrowed manner. An exposure method suitable for this purpose uses two or more light sources at some distance from each other, as described in German patent application No. 2,248,878. A tube embodying the invention can alternatively be made with the aid of so-called electronic exposure, in which the sensitive layer on the window portion is "exposed" by means of an electron beam.

What is claimed is:

1. In the manufacture of a color display tube having an apertured shadow mask comprising a first and second electrode structure for producing electron focusing fields in the mask apertures, the method comprising the steps of providing each of a first plurality of elongated conductors with at least one insulating support, laying said conductors of said first plurality onto a metal sheet having a plurality of openings defining a second plurality of elongated, substantially parallel conductors therebetween so that said conductors of said first plurality are spaced and electrically insulated from said sheet by said supports, extend transversely of said conductors of said second plurality and are spaced from each other to define a plurality of openings therebetween which are aligned with at least portions of said openings in said sheet to thereby form apertures for passage of electrons, securing said supports to said metal sheet to thereby form said shadow mask, said conductors of said first and second plurality defining said first and second electrode structures, respectively, such that, upon application of a potential difference therebetween, electron focusing fields are produced in said apertures, and mounting said shadow mask in an envelope of said display tube.

2. The method according to claim 1 wherein said openings in said sheet are arranged in substantially parallel, spaced rows and columns each having a plurality of said openings spaced from each other, said openings in adjacent columns defining said conductors of said second plurality therebetween, and wherein said conductors of said first plurality are layed onto said sheet so that they extend between adjacent rows substantially perpendicularly to the direction of said columns.

3. The method according to claim 2 wherein said conductors of said first plurality are in the form of strips each provided with a plurality of said supports spaced along the length thereof.

4. The method according to claim 1 wherein each conductor of said first plurality is provided with an elongated support which extends along the length thereof.

5. The method according to claim 1 wherein said step of laying includes the step of stretching said conductors provided with said supports across said sheet.

6. The method according to claim 5 wherein a plurality of said conductors provided with said supports is stretched simultaneously across said sheet.

7. The method according to claim 1 wherein said step of securing includes adhering said supports to said sheet.

8. The method according to claim 1 wherein said supports are made of glass and said step of laying includes laying said supports on said sheet while said glass is in a soft condition.

9. The method according to claim 1 wherein said supports are strips of polyimide.

10. The method according to claim 1 wherein said step of providing includes anodizing one side of an elongated conductor made of aluminum to thereby form said insulating support.

11. In the manufacture of a color display tube having an apertured shadow mask comprising a first and second electrode structure for producing electron focusing fields in the mask apertures, the method comprising the steps of providing elongated conductors on each of two opposite sides of each of a plurality of elongated supports, laying said supports with said conductors provided thereon onto a metal sheet having a plurality of elongated, spaced openings with the longitudinal axes thereof extending substantially parallel to each other, said openings in said sheet defining a plurality of conductors therebetween, said supports being laid on said sheet so that said conductors on said supports extend substantially perpendicularly to said longitudinal axes with one conductor on each of said supports facing said sheet and the other conductors on said supports being spaced and electrically insulated from said sheet by said supports, said other conductors being spaced from each other to define a second plurality of openings therebetween which are aligned with at least portions of said openings in said sheet to thereby form apertures for passage of electron beams, securing said one conductors to said metal plate to thereby form said shadow mask, said other conductors and said plurality of conductors defining said first and second electrode structures, respectively, such that, upon application of a potential difference therebetween, electron focusing fields are produced in said apertures, and mounting said shadow mask in an envelope of the display tube.

* * * * *